United States Patent [19]

Busse

[11] 4,142,271

[45] Mar. 6, 1979

[54] CABINET HINGE

[75] Inventor: Peter Busse, Vlotho, Fed. Rep. of Germany

[73] Assignee: Richard Heinze, Fed. Rep. of Germany

[21] Appl. No.: 822,260

[22] Filed: Aug. 5, 1977

[30] Foreign Application Priority Data

Aug. 5, 1976 [DE] Fed. Rep. of Germany ..... 2635237

[51] Int. Cl.[2] ..... E05D 7/04

[52] U.S. Cl. ..... 16/129

[58] Field of Search ..... 16/129–134, 16/137, 163, 164, 128 R

[56] References Cited

U.S. PATENT DOCUMENTS

| | | | |
|---|---|---|---|
| 974,451 | 11/1910 | Vanderveld | 16/130 |
| 1,174,326 | 3/1916 | Koliha | 16/130 |
| 2,611,921 | 9/1952 | Weidelstam | 16/129 |
| 3,909,879 | 10/1975 | Grünert et al. | 16/129 X |

FOREIGN PATENT DOCUMENTS

| | | | |
|---|---|---|---|
| 937993 | 1/1956 | Fed. Rep. of Germany | 16/132 |
| 1759642 | 7/1971 | Fed. Rep. of Germany | 16/129 |
| 2041138 | 2/1972 | Fed. Rep. of Germany | 16/129 |
| 2460943 | 7/1976 | Fed. Rep. of Germany | 16/137 |
| 2524419 | 12/1976 | Fed. Rep. of Germany | 16/137 R |
| 2307107 | 11/1976 | France | 16/129 |

*Primary Examiner*—James Kee Chi

*Attorney, Agent, or Firm*—Jacobs & Jacobs

[57] ABSTRACT

Cabinet hinge having a base or adjustment plate attached to one cabinet part by means of fastening elements which engage into said cabinet part, and having a hinge arm fastened, preferably adjustably, to the adjustment plate and bearing at least one hinge pin, characterized by at least one adjustment element by which the base or adjustment plate is fastened to the cabinet part for adjustment in the direction of the hinge pin.

13 Claims, 18 Drawing Figures

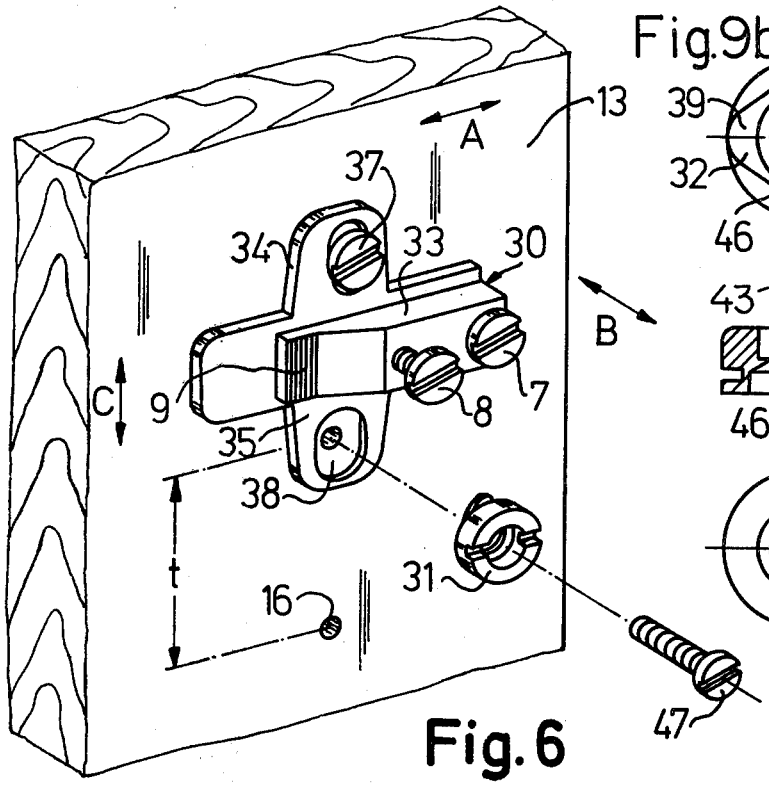
Fig. 6
Fig. 9a
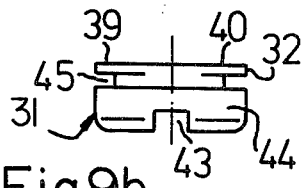
Fig. 9b
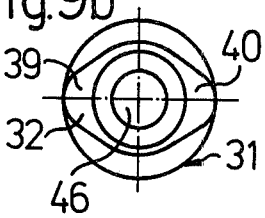
Fig. 9c
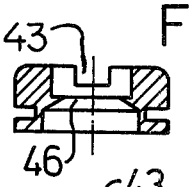
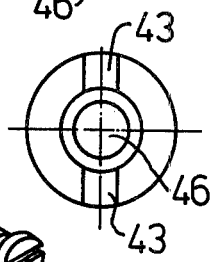
Fig. 9d
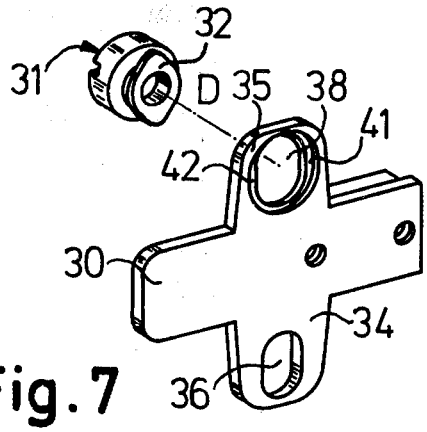
Fig. 7
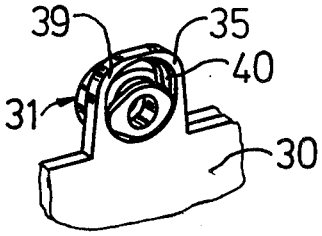
Fig. 8

CABINET HINGE

This invention relates to a cabinet hinge having a base or adjustment plate which can be fastened to a cabinet part by means of fastening elements which engage into said cabinet part, and a hinge arm bearing at least one hinge pin and fastened, preferably adjustably, to the adjustment plate.

Cabinet hinges and their hinge arms are today, to an increasing extent, no longer being fastened directly to a cabinet body or cabinet side-wall; rather, a base plate or adjustment plate which is held by its own fastening elements to the cabinet body and to which the hinge arm or fitting part bearing the hinge pin which is secured to the cabinet is then anchored, is used for holding the hinge arm (fitting part) which is to be attached to the cabinet body. The use of such a base plate or adjustment plate affords the advantage that it is possible, by means of it, to obtain an adjustable support of the hinge arm on the cabinet body, as is extremely important in order to compensate for manufacturing tolerances, particularly in the case of hinges whose system of articulation consists of two hinge levers and four hinge pins. Furthermore, the use of such base or adjustment plates affords the advantage that these plates can be premounted by the cabinet manufacturer, for instance on the side walls of the cabinet, while the doors, which are taken off or removed from the body of the cabinet for transportation and which are premounted with the other hinge parts, can be fastened at the final consumer's in particularly simple fashion to the body of the cabinet even by laymen by merely placing the hinge arms on the premounted base or adjustment plates and screwing them on there. While previously adjustment of the hinge in longitudinal direction of the hinge arm parallel to the surface of the side wall of the cabinet and furthermore perpendicular to said surface was customary with such hinge arms provided with a base or adjustment plate, it has already recently been proposed that such adjustment be effected also transversely to the longitudinal direction of the hinge arm and parallel to the surface-side of the side wall of the cabinet, i.e., in the direction towards the hinge pins provided on the hinge arm, in order to make compensation for possible tolerances in the vertical application of the base or adjustment plates to the cabinet side wall in question possible, for instance in the case of a cabinet having a plurality of hinges arranged one above the other on one side wall of the cabinet.

The previously known base or adjustment plates which permit of such a "transverse adjustment" are not particularly suitable either functionally or from a standpoint of mounting technique and are frequently extremely complicated in construction and therefore expensive to manufacture.

The object of the present invention is to avoid the disadvantages of the known hinges having transverse adjustment and to provide a cabinet hinge which, despite the possibility of transverse adjustment, consists of the smallest possible number of individual parts and is thus cheap to manufacture and the attachment of which to a cabinet side wall can be effected at little expense. Furthermore it should be possible for the hinge, in case of its transverse adjustment out of the central position, to be returned into said central or zero position by a simple manual manipulation.

In order to achieve this purpose, a cabinet hinge of the above-described type is developed, in accordance with the invention, in the manner that at least one adjustment element is provided, by means of which the base or adjustment plate is fastened, adjustable in direction of the hinge pin, to the cabinet part.

The hinge of the invention affords the advantage that the base or adjustment plate need not consist of two plate-shaped parts which are displaceable with respect to each other for the transverse adjustment, but rather the base or adjustment plate can be fastened directly to the surface of the cabinet part, the means for attaching or holding the base or adjustment plate to the cabinet part simultaneously serving also for the transverse adjustment.

Further developments of the invention are described in the subordinate claims.

The invention will be described in further detail below with reference to two embodiments shown in the drawing in which.

Figures 1, 2, 3A, 3B, 3C:
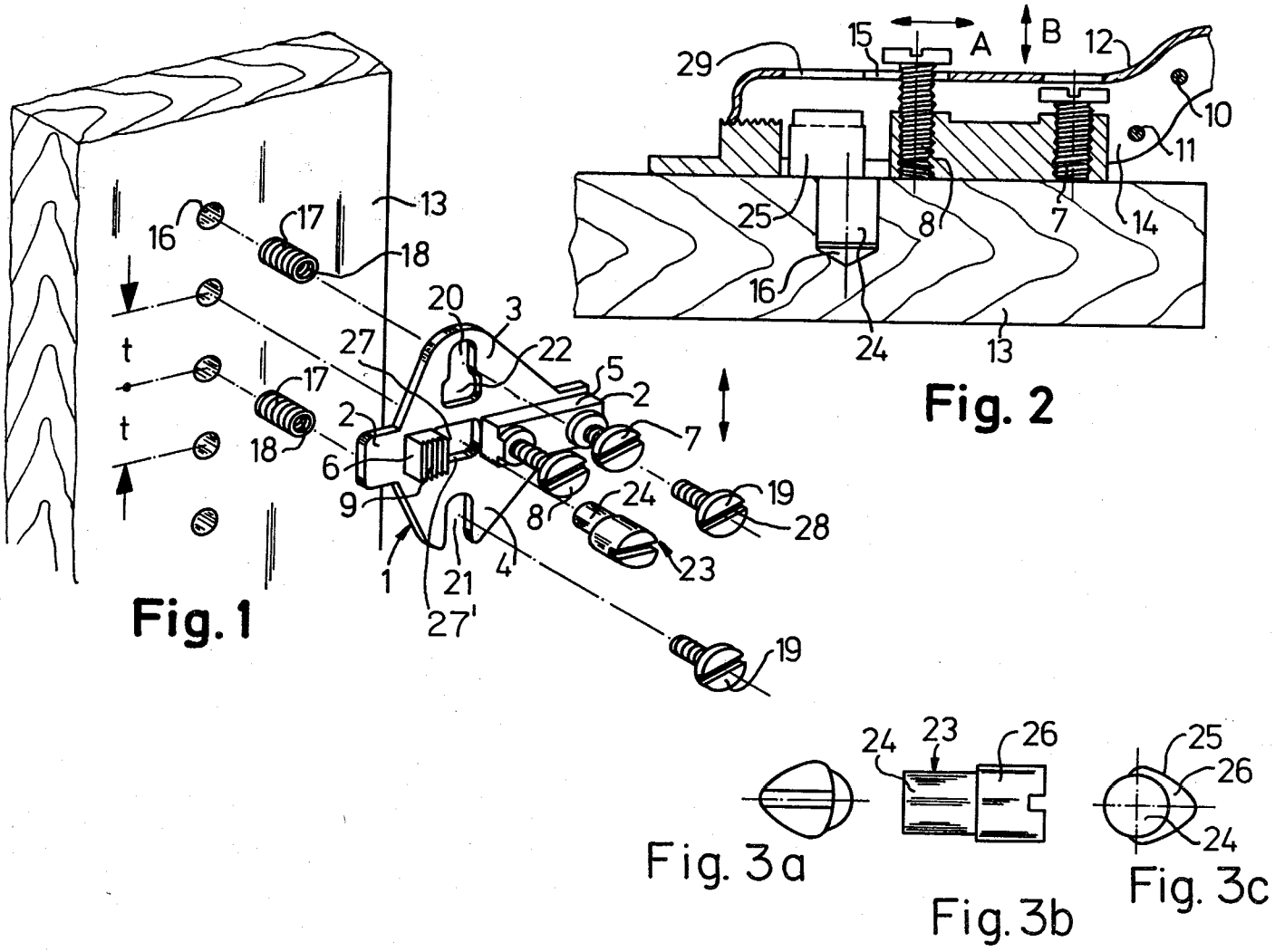
FIG. 1 shows, in a perspective exploded view, a base or adjustment plate for a hinge in accordance with the invention together with a cabinet side wall.
FIG. 2 is a longitudinal section through the base or adjustment plate of FIG. 1 and through the hinge arm of the hinge in accordance with the invention.
Figure 4:
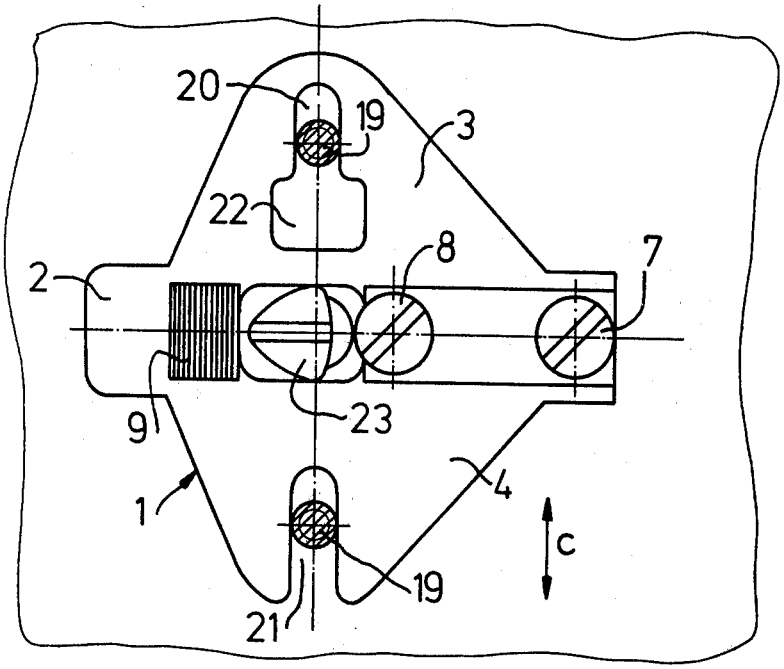
Figure 5:
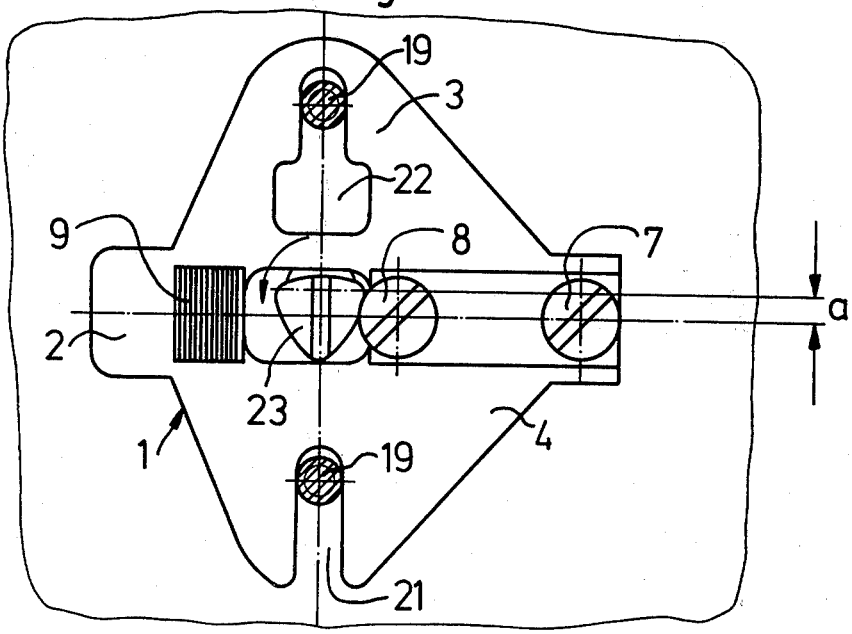
Figure 11:
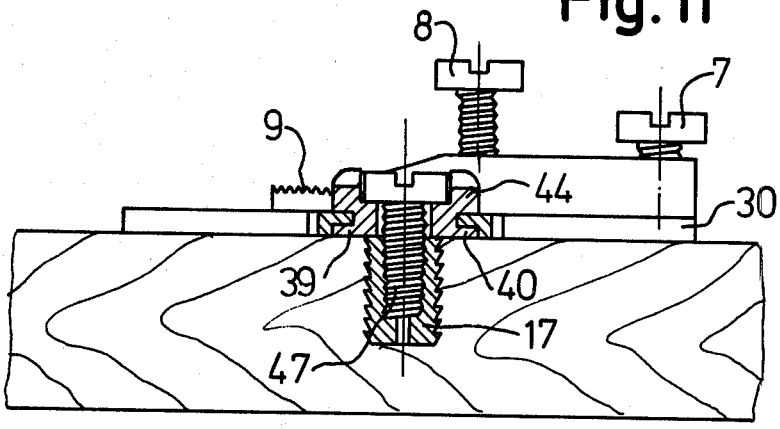
Figure 10:
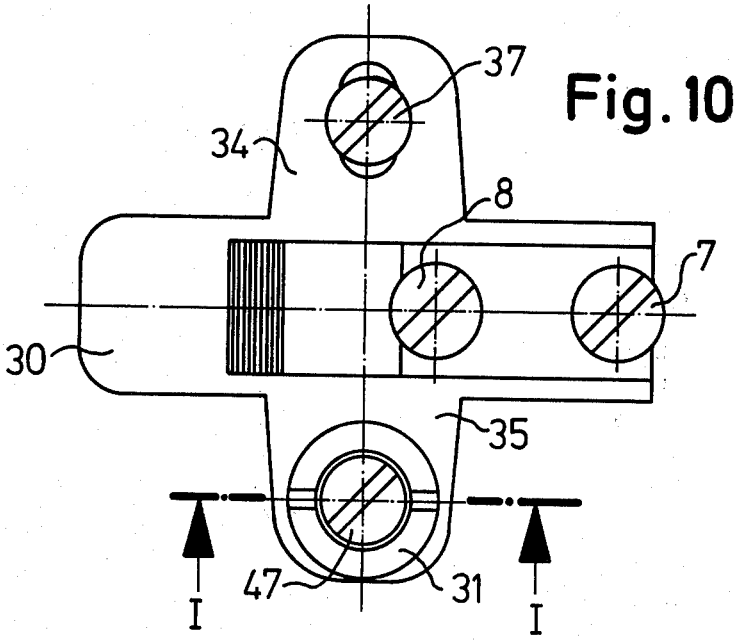
Figure 12:
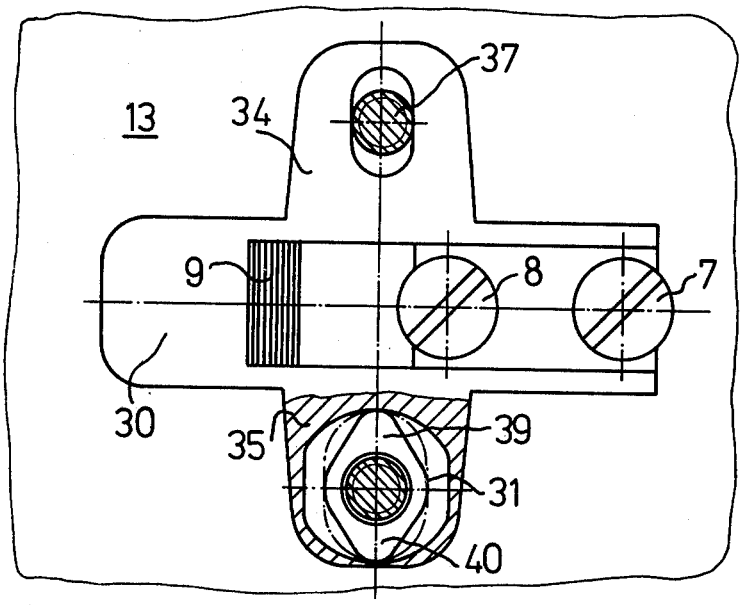
Figure 13:
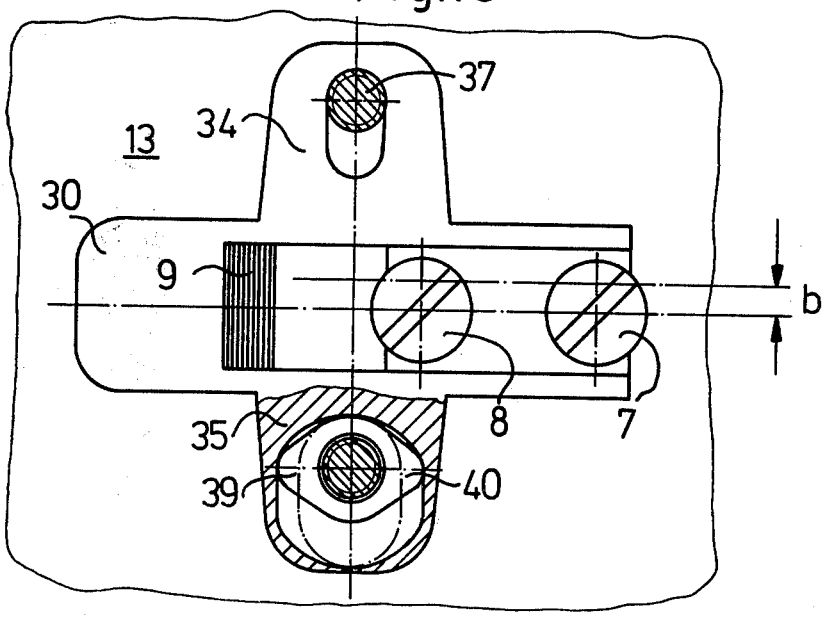

FIGS. 3*a* to 3*c* show in front view, side view, and rear view, respectively, a fastening element provided with an eccentric surface for use with the hinge of FIGS. 1 and 2;

FIGS. 4 and 5 show the base or adjustment plate of FIG. 1 in top view in different angular positions of the fastening element provided with the eccentric surface;

FIG. 6 shows in perspective, a modified embodiment of a base or adjustment plate for use with the hinge of the invention, together with a cabinet side wall;

FIG. 7 shows, in perspective, the base or adjustment plate of FIG. 6, seen from the side facing the cabinet side wall, and provided with a sleeve having the eccentric surface;

FIG. 8 shows a detail of FIG. 7 with the sleeve held in an opening in the base or adjustment plate;

FIGS. 9*a* to 9*d* show the sleeve having the eccentric surface in side view, rear view, section, and front view respectively;

FIG. 10 shows the base or adjustment plate of FIG. 6 in plan view;

FIG. 11 is a section through the base or adjustment plate along the line I—I of FIG. 10;

FIGS. 12 and 13 are plan views of the base or adjustment plate of FIG. 6 with fastening lugs shown in part in a section parallel to the surface of the cabinet side wall and with different angular positions of the sleeve provided with the eccentric surface.

The hinge shown in FIGS. 1 to 5 consists of a base or adjustment plate 1 which has a substantially rectangular central part 2 as well as two fastening lugs 3 and 4 extending in each case laterally away from said central part. The central part 2 is provided on its one surface side with elevations 5 and 6 of rectangular or square cross section, the elevation 5 containing threaded boreholes for an adjustment screw 7 as well as a fastening screw 8, while the elevation 6 has a detent toothing 9.

By means of the screws 7 and 8 as well as the detent toothing 9, a fitting or hinge arm 12 bearing the hinge pins 10 and 11 is fastened to the base or adjustment plate in such a manner that it can be adjusted in the longitudinal direction of the hinge arm, i.e. in the direction indicated by the double arrow A, as well as in the direction perpendicular to the surface of a cabinet side wall 13, i.e. in the direction indicated by the double arrow B. For this purpose, the hinge arm 12 is of U-shape in cross section and its arms 14 engage, fixed against rotation, the elevations 5 and 6, the fastening screw 8 extending through a slot 15 in the yoke portion of the hinge arm 12, developed of U-shaped cross section, in order to achieve longitudinal adjustment in the direction of the double-ended arrow A, and the head of the adjustment screw 7 resting against the bottom of the yoke piece of the U-shaped hinge arm 12 in order to obtain adjustment perpendicular to the surface of the cabinet side wall 13.

For the attachment of the base or adjustment plate to the cabinet side wall 13 there are used the boreholes 16 which are provided there and which are part of a series of holes which can serve, for instance, also for fastening shelves or partitions to a cabinet, the boreholes 16 being at a predetermined distance t from each other.

For the fastening of the base of adjustment plate 1 of the hinge shown in FIGS. 1 to 5 there are required three adjacent boreholes 16 of the row of holes, fastening sleeves 17 being inserted into the two outer boreholes 16 in such a manner that said sleeves protrude slightly beyond the surface of the cabinet side wall 13. The sleeves 17 have internal boreholes 18 for fastening screws 19 which, when the base or adjustment plate 1 is attached, pass through slots 20 and 21 provided in the fastening lugs 3 and 4 and are screwed into the sleeves 17. The slots 20 and 21 are sufficiently wide so that the ends of the fastening sleeve 17 which extend beyond the surface of the cabinet side wall 13 have sufficient space in the slots 20 and 21 and the base or adjustment plate 1 rests directly against the fastening sleeves 7 in order to relieve the fastening screws 19.

However, it is also possible to develop the slots 20 and 21 in such a manner that they have a greater width on the lower side of the base or adjustment plate 1 facing the cabinet side wall 13 than they do on the surface side of the base or adjustment plate facing away from the cabinet side wall 13, the fastening sleeves 17 or the ends thereof protruding beyond the surface of the cabinet side wall 13 then extending merely into the region of greater width of the slots 20 and 21 on the side of the base or adjustment plate facing the cabinet side wall 13.

As is furthermore shown in the figures, the slot 21 is open towards the free end of the fastening lug 4, while the slot 20 opens at its end facing the central part 2 into an opening 22 whose cross section is substantially larger than the width of the slot 20 and, furthermore, also larger than the head of the fastening screws 19. In this way, it is possible to premount the fastening screws 19 together with the fastening sleeves 17 on the cabinet side wall 13, so that thereupon, when fastening the base or adjustment plate 1 to the cabinet side wall 13, the fastening screws 19 can be introduced from the side or through the opening 22 into the slots 20 and 21 respectively.

The middle one of the three boreholes 16 which are required for attaching the base or adjustment plate 1 to the cabinet side wall 13 serves to receive a bolt-like element 23 which has a section 24 which is circular in cross section and adapted to the diameter of the borehole 16, as well as a section 26 of larger cross section which forms an eccentric surface 25.

While the section 24 is located within the corresponding borehole 16 of the cabinet side wall 13 when the base or adjustment plate 1 is fastened, the section 26 which protrudes beyond the surface of the cabinet side wall 13 extends into a substantially rectangular or square opening 27 which is provided in the central part 2 of the base or adjustment plate 1 between the elevations 5 and 6, the eccentric surface 25 provided on the section 26 resting against the edge surface of inner surface 27' of the opening 27 which is adjacent the fastening lugs 3 and 4 respectively (FIGS. 4 and 5). By turning the bolt-shaped element 23 in the borehole 16 of the cabinet side wall 13, for instance by means of a screwdriver engaged in the slot 28, the base or adjustment plate 1 is displaced by the eccentric surface 25 resting against the edge surfaces 27' in the direction transverse to the longitudinal axis of the hinge arm 12, i.e. in the direction indicated by the double-ended arrow C, so that adjustment of the hinge or the hinge arm 12 in all three directions in space (A, B, and C) is possible.

The mounting and adjustment of the base or adjustment plate 1 is effected in actual practice in the manner that this plate is first of all pushed, in the manner described above, from the side onto the holding screws 19 premounted in the cabinet side wall 13 or the fastening sleeves 17, whereupon the cylindrical section 24 of the bolt-shaped element 23 is inserted, through the opening 27 in the base or adjustment plate, into the corresponding borehole 16 of the cabinet side wall 13. Since the length of the slots 20 and 21 is preferably at least equal to the maximum range of adjustment of the base or adjustment plate 1 which can be obtained by means of the eccentric surface 25 in the direction indicated by the double-ended arrow C upon turning the bolt-shaped element 23, the base or adjustment plate 1 is secured against accidentally falling out of the provisional anchoring of the cabinet side wall 13 after insertion of the bolt-shaped element 23 into the corresponding borehole 16 of the cabinet side wall 13, even if the holding screws have loosened, and independently of the angular position of the bolt-shaped element 23. After the insertion of the bolt-shaped element 23 into the borehole 16 of the cabinet side wall 13, said element is turned in such a manner that the base or adjustment plate 1 assumes, with respect to its transverse adjustment in the direction indicated by the arrow C, the central position shown in FIG. 4, in which the slot 28 points in the lengthwise direction of the base or adjustment plate 1. If it is now found that adjustment in transverse direction is not necessary, the fastening screws 19 are tightened and the mounting of the base or adjustment plate 1 is complete.

If adjustment in transverse direction or in the direction indicated by the double-ended arrow C is necessary, then the bolt-shaped element 23 is turned in clockwise or counterclockwise direction by means of a screwdriver, inserted into the slot 28, until the base or adjustment plate 1 assumes the prescribed position; in the case of the showing of FIGS. 4 and 5, the turning of the bolt-shaped element 23 in counterclockwise direction effects a displacement of the base or adjustment plate 1 downward from the central position shown in FIG. 4, and a turning of the bolt-shaped element 23 in clockwise direction effects a displacement upwards from the central position shown in FIG. 4. The maximum possible displacement in one direction (downward) from the middle position shown in FIG. 4 is designated "a" in FIG. 5, the slot 28 being directed transverse to the lengthwise axis of the base or adjustment plate 1 upon such maximum displacement. By the use of the bolt-shaped element provided with the eccentric surface 25 for the transverse adjustment, a very precise adjustment is possible even when the hinge parts are acted on by the weight of the door, the adjustment, after once being effected, being maintained by the bolt-shaped element until the holding screws 19 have been tightened. In order to avoid, in this connection, an undesired turning of the bolt-shaped element in the borehole 16, for instance as a result of the weight of the door acting on the hinge parts, the diameter of the circular section 24 is so selected with respect to the corresponding borehole 16 that the section 24 is seated fixed tightly in the borehole 16.

An additional safety measure, inward extending detent toothings can also for, instance, be provided on the eccentric surface 25 as well as on the edge sections 27' of the opening 27. In order to make it possible to actuate the bolt-shaped element 23 even when the hinge arm 12 is fastened to the base or adjustment plate 1, said arm is provided, in the region of its yoke portion, with an opening 29 through which the slot 28 of the bolt-shaped element 23 is accessible for a screwdriver.

FIGS. 6 to 13 show a base or adjustment plate 30 with which the transverse displacement or the displacement in the direction of the axis C is obtained by means of a sleeve 31 with eccentric surface 32. The base or adjustment plate 30 has a central part with an elevation 33 which has threaded boreholes for the adjustment screw 7 and for the fastening screws 8, and on which the hinge arm 12, not shown in detail in FIGS. 6 to 13, is fastened for adjustment along the axes A and B by means of said screws, in the same manner as described above in connection with FIGS. 1 to 5. In order to hold the base or adjustment plate 30 to the cabinet side wall 13, there are provided, developed on said plate, fastening lugs 34 and 35 which extend laterally away from the central part of the base or adjustment plate 30, the fastening lug 34 being provided with a slot 36 for a fastening screw 37 which engages into a borehole 16. The fastening lug 35 has a continuous opening 38 whose length in the direction of the fastening lug 35, i.e. in the direction of the arrow C, is greater than the width of this opening 38 in the direction transverse to the fastening lug 35, the length of the opening 38 corresponding approximately to the maximum spacing of the wing-shaped extensions 39 and 40 of sleeve 31 which form the eccentric surface 32. The wing-shaped extensions 39 and 40 — as shown in particular in FIG. **9*b* — are arranged symmetrically with respect to the axis D of the sleeve 31 and thus form a double, approximately elliptical, eccentric surface 32**.

Within the region of the opening 38, the fastening lug 35 is provided, on the bottom side facing the cabinet side wall 13, furthermore with a recess 41 which is of approximately circular shape and has a diameter which corresponds to the length of the opening 38, so that undercut surfaces 42 are produced at least on the longitudinal sides of the opening 38 which extend in the direction indicated by the arrow C, the wing-shaped extensions 39 and 40 of the sleeve 31 engaging behind said undercuts when the sleeve 31 is turned by 90° from the position shown in FIG. 7 into the position shown in FIG. 8 after the insertion of the end thereof provided with said extensions into the opening 38; in the position shown in FIG. 8, the sleeve-shaped extensions 39 and 40 extend transversely to the fastening lug 35, i.e. in the direction indicated by the arrow A. In this connection, the thickened head part 44 of the sleeve 31 which is provided with a screwdriver slot 43 lies against the surface side of the fastening lug 35 facing away from the cabinet side wall 13 within the region of the opening 38, and the sections of material forming the undercut surfaces 42 lie, with a position of the sleeve 31 such as shown in FIG. 8, in the gap 45 formed between the wing-shaped extensions 39 and 40 and the head part 44.

A fastening screw 47 engages through the borehole 46 of the sleeve 31 and can also be screwed into a borehole 16 of the cabinet side wall 13. The borehole 46 of the sleeve 31 is developed in such a manner that the head of the fastening screw 47, when screwed in place, lies countersunk in the sleeve 31 so that the screwdriver slot 43 of the sleeve 31 is accessible to a screwdriver, without this being impeded by the fastening screw 47, and thus the sleeve 31 can be manipulated with a larger screwdriver and the fastening screw 37 with a smaller screwdriver.

The mounting or attachment of the base or adjustment plate 30 to the cabinet side wall 13 is effected in the manner that, with the sleeve 31 inserted in the opening 38 (FIG. 8), said plate is fastened by the fastening screws 37 and 47 to the cabinet side wall 13, the fastening screws for the time being not being completely tightened. The sleeve 31 is now turned from the position thereof shown in FIG. 8 into a position which corresponds approximately to a middle position between the extreme positions shown in FIGS. 12 and 13 and in which the screwdriver slot 43 lies approximately at an angle of 45° to the lengthwise axis of the base or adjustment plate 30 and to the axis indicated by the arrow A. In this position, the base or adjustment plate 30 has its central position with respect to its transverse adjustment (adjustment in the direction of the arrow C).

If it is now found that adjustment of the base or adjustment plate 30 in transverse direction is not necessary, the fastening screws 37 and 47 are tightened.

If adjustment is necessary, then the sleeve 31 is turned in clockwise or counterclockwise direction around the fastening screw 47 by means of a screwdriver which is engaged in the screwdriver slot 43, depending on the further adjustment necessary; in this connection, the eccentric surface 32 formed by the wing-shaped extensions 39 and 40 slide/along the inner edge of the recess 41 and effect the displacement of the base or adjustment plate 30 in the direction indicated by the arrow C. The two end positions which are possible upon this transverse adjustment are shown in FIGS. 12 and 13, the range of maximum adjustment being indicated by B in FIG. 13. After the adjustment has been effected, the fastening screws 37 and 38 are tightened, and during the adjustment the position of the base or adjustment plate 30 is fixed by the sleeve 31 or by its eccentric surfaces in cooperation with the edge of the recess 41.

The development of the hinge of the invention in the manner shown in FIGS. 6 to 13 has the advantage over the development shown in FIGS. 1 to 5 that only two boreholes 16 are required in the cabinet side wall 13 for the attachment of the base or adjustment plate 30.

I claim:

1. In a cabinet hinge base plate attachable to one cabinet part through fastening means engaging said cabinet part, and being operable to receive a hinge component bearing at least one hinge pin for adjustable positioning of said hinge component along the two axes perpendicular to the axis of said hinge pin, the improvement which comprises adjustment means comprising an eccentric element rotatably mounted on said cabinet part and an abutment surface on said plate cooperating with said eccentric element to urge said plate along an axis parallel to that of said hinge pin, said plate further having slots running parallel to the axis of said hinge pin and operable to receive said fastening means.

2. A cabinet hinge base plate according to claim 1 wherein said eccentric element is rotatable around an axis perpendicular to the surface of the cabinet part.

3. A cabinet hinge base plate according to claim 1 wherein said base plate is provided with a continuous opening whose inner surface comprises said abutment surface and in which opening is disposed in said eccentric element.

4. A cabinet hinge base plate according to claim 1 wherein said eccentric element comprises a first cylindrical portion operable to be rotatably mounted within a bore hole in said cabinet part and an eccentric portion of enlarged cross section.

5. A cabinet hinge base plate according to claim 1 wherein said base plate is provided with at least one lug laterally protruding parallel to the plane of the cabinet surface, at least one of said slots being disposed in said lug and said fastening means being screw means.

6. A cabinet hinge base plate according to claim 5 wherein said base plate is provided with two laterally protruding fastening lugs, the slot in a first of said fastening lugs being open towards the free end of said first lug and the slot in the second of said fastening lugs discharges, at the end most proximate to said first lug, into a recess of sufficiently enlarged cross section to admit said screw means.

7. A cabinet hinge base plate according to claim 6 wherein the slots in said first and second lugs are linearly disposed on each side of said eccentric element.

8. A cabinet hinge base plate according to claim 7 wherein the surface sides of said lugs facing the cabinet part are recessed about said slots to receive fastening sleeves associated with said screw means.

9. A cabinet hinge base plate according to claim 1 wherein said eccentric element is a sleeve mountable on said fastening means and said abutment surface is defined in the associated slot.

10. A cabinet hinge base plate according to claim 9 wherein said sleeve comprises a thickened end head portion defining a screwdriver slot and a symmetrically developed double eccentric end portion.

11. A cabinet hinge base plate according to claim 10 wherein said base plate is provided with at least one lug laterally protruding parallel to the plane of the cabinet surface, said abutment surface defining slot being disposed in said lug.

12. A cabinet hinge base plate according to claim 11 wherein said abutment surface is defined by a circular depression defined on the surface side of said lug facing said cabinet part.

13. A cabinet hinge base plate according to claim 12 wherein said sleeve includes a cylindrical section of reduced cross section intermediate to said thickened head portion and said eccentric end portion, said cylindrical section riding in said slot with said thickened head portion facing away from the cabinet part and said eccentric surface is disposed in said circular depression.

* * * * *